US005498184A

United States Patent [19]

Saghri

[11] Patent Number: 5,498,184

[45] Date of Patent: Mar. 12, 1996

[54] BODY BOARD HAVING A HYDRODYNAMIC PROPULSION SURFACE

[76] Inventor: Abdolhamid Saghri, 8207 Stone Trail Dr., Bethesda, Md. 20817

[21] Appl. No.: 404,719

[22] Filed: Mar. 15, 1995

[51] Int. Cl.[6] ..... A63C 15/00

[52] U.S. Cl. ..... 441/65; 440/9

[58] Field of Search ..... 441/65, 66, 67, 441/69, 74, 79; 440/22, 9

[56] References Cited

U.S. PATENT DOCUMENTS

| | | | |
|---|---|---|---|
| D. 183,010 | 6/1958 | Martin . | |
| D. 192,713 | 5/1962 | Lowrey . | |
| D. 199,470 | 10/1964 | Ziff . | |
| D. 207,681 | 5/1967 | Heston . | |
| D. 216,445 | 1/1970 | Vasilatos . | |
| D. 216,446 | 1/1970 | Vasilatos . | |
| D. 216,447 | 1/1970 | Vasilatos . | |
| D. 216,448 | 1/1970 | Vasilatos . | |
| D. 216,530 | 3/1970 | Ziff . | |
| D. 245,973 | 10/1977 | Vasilatos . | |
| D. 247,924 | 5/1978 | Yamanaka . | |
| D. 323,371 | 1/1992 | Ohtaka . | |
| D. 350,933 | 9/1994 | Scarabone . | |
| 688,672 | 12/1901 | Niemeyer . | |
| 1,315,267 | 9/1919 | White . | |
| 1,865,985 | 7/1932 | Wheeler . | |
| 3,254,622 | 6/1966 | Bramson | 440/22 |
| 3,320,625 | 5/1967 | Schlueter | 441/65 |
| 3,543,712 | 12/1970 | Vasilatos . | |
| 3,617,070 | 11/1971 | Roberts | 441/65 |
| 3,722,015 | 3/1973 | Miller et al. | 441/65 |
| 4,886,476 | 12/1989 | Brocone et al. . | |
| 4,929,207 | 5/1990 | Piatt . | |
| 5,318,467 | 6/1994 | McIntyre . | |
| 5,389,023 | 2/1995 | McIntyre . | |

*Primary Examiner*—Stephen Avila
*Attorney, Agent, or Firm*—Cushman Darby & Cushman

[57] ABSTRACT

A body board having a body member and a pair of extensions removably coupled to the body member. The pair of extensions provide a rearward-facing surface that generally faces away from the stern of the body member so that the force of a fluid delivered against the rearward-facing surface propels the body board.

20 Claims, 7 Drawing Sheets

BODY BOARD HAVING A HYDRODYNAMIC PROPULSION SURFACE

BACKGROUND OF THE INVENTION

1. Field of the Invention

The present invention pertains to a body board, and in particular, to a body board having a pair of selectively removable or integral extensions, wherein each extension provides a hydrodynamic propulsion surface at the rear of the body board so that fluid impacting on the hydrodynamic surface propels the body board.

2. Description of the Related Art

Recreational aquatic devices, such as body boards or boogie boards, are well known. These devices provide a buoyant surface on which a person lies, sits, or stands. The user propels the body board by paddling, kicking and/or by positioning the body board in front of an incoming wave so that the body board surfs down the front of the wave. To use a conventional body board, the user lies on the body board so that the upper torso is supported by the body board. The user positions the board relative to the incoming wave so that as a wave lifts the body board, gravity propels the body board enabling the body board and rider to surf down the face of the wave. Using a body board in this manner requires a great degree of skill and expertise in order to position the body board properly relative to the incoming waves and to maneuver the board when on the wave so as to continue surfing the wave while the wave progresses toward shore.

Less experienced users of a conventional body board, such as children and individuals who are unable to swim, are unable to use the above-described conventional body board to surf an incoming wave. Instead, less experienced users tend to lie or sit on the conventional body board and let the crashing waves propel the body board forward. When using a conventional body board in this manner, the propulsion force imparted on the body board and user comes from force of the waves impacting on the rear surface of the body board as well as on the rearward facing surface of the user. However, when using a body board in this manner, the propulsive force imparted on the body board is relatively small due to the small surface area against which the incoming waves impact.

In addition, inexperienced body board users have difficultly maintaining their balance on a conventional body board, especially as the waves impact on the body board and user, due to the instability of conventional body boards.

Other conventional aquatic devices, such as those taught by U.S. Pat. Nos. 1,865,985 and 1,315,267, include a device attached to the underside of a floating surfboard. When the speed of the water rushing under the craft is greater than the speed of the craft, the device attached to the underside of the draft actuates so as to provide an obstacle against which the rushing water impacts for propelling the craft.

In the conventional aquatic devices described immediately above, the mechanical device is attached to the underside of the surfboard. As a result of this configuration, the device attached to the underside of the surfboard must necessarily be movable so that when the surfboard is moving at least as fast as the rushing water, the device is moved to a position whereby drag is reduced so that the device does not slow down the surfboard. Providing a moving mechanical device complicates the manufacture of the surfboard. In addition, the device may not reliably operate, can be easily damage, and will likely wear out over time.

SUMMARY OF THE INVENTION

It is an object of the present invention to provide a body board and a propulsion system for a body board that overcomes the problems associated with the above-described conventional body boards. In this regard, it is a further object of the present invention to provide a body board that is easy to use and more stable than conventional body boards and the provides a propulsive surface that overcomes the problems of the above-described devices attached to the underside of a floating surfboard.

In accordance with the principles of the present invention, the foregoing objects are achieved by providing a body board including a body member having a bow and a stern that provides a surface capable of supporting a person lying thereon. A pair of extensions are coupled to the body member such that an entirety of each extension is substantially maintained in a fixed position relative to the body member. Each extension provides a surface generally facing the stern of the body member so that fluid delivered in a direction generally from the stern toward the bow of the body member exerts a force against this generally rearward-facing surface to propel the body board. Furthermore, each extension is shaped so that an area defined by the rearward-facing surface is substantially equivalent to a maximum cross-sectional area of that extension taken along a plane perpendicular to a longitudinal axis of the body member and so that the maximum cross-sectional area of that extension is only located proximate to the stern of the body member.

It is another object of the present invention to provide a propulsion system that can be quickly and easily installed on a conventional body board device to enhance the propulsive capability and stability of that body board. This objective is achieved in the present invention by providing a first extension that is selectively attached to a starboard side of a body board and a second extension that is selectively attached to a port side of the body board. The first and second extensions are constructed and fastened to the respective sides of the board by a fastening assembly such that the entirety of the first and second extensions are substantially maintained in a fixed position relative to the body member. Each of the first and second extensions provides a surface generally facing the stern of the body board when coupled thereto so that fluid delivered in a direction generally from the stern toward a bow of the body board exerts a force against this rearward-facing surface to propel the body board. In addition, the first and second extensions have a cross-sectional area defined by a plane that is perpendicular to a longitudinal axis of the body board that generally increases in a direction toward the stern of the body board so that an area defined by the rearward-facing surface at the stern of the body board corresponds to a maximum cross-sectional area of that extension.

The above-described propulsion system is capable of being retrofitted onto conventional body board devices or selectively attached to a body board device specially designed to receive such extensions. The selectively attachable extensions thereby enhance the ability of the conventional body board to be propelled by the force of fluid impacting on the rearward-facing surface of each extension as well as the stability thereof.

Further objects, features and characteristics of the present convention, as well as the functions of the related elements of the structure, and the economies of manufacture will become more apparent upon consideration of the foregoing description and the appended claims with reference to the accompanying drawings, all of which form a part of the specification, wherein like reference numerals designate corresponding parts of the various figures.

DETAILED DESCRIPTION OF THE PRESENTLY PREFERRED EMBODIMENTS

An exemplary embodiment of a body board according to the principles of the present invention is discussed below with reference to FIGS. 1–4.

Figure 1:
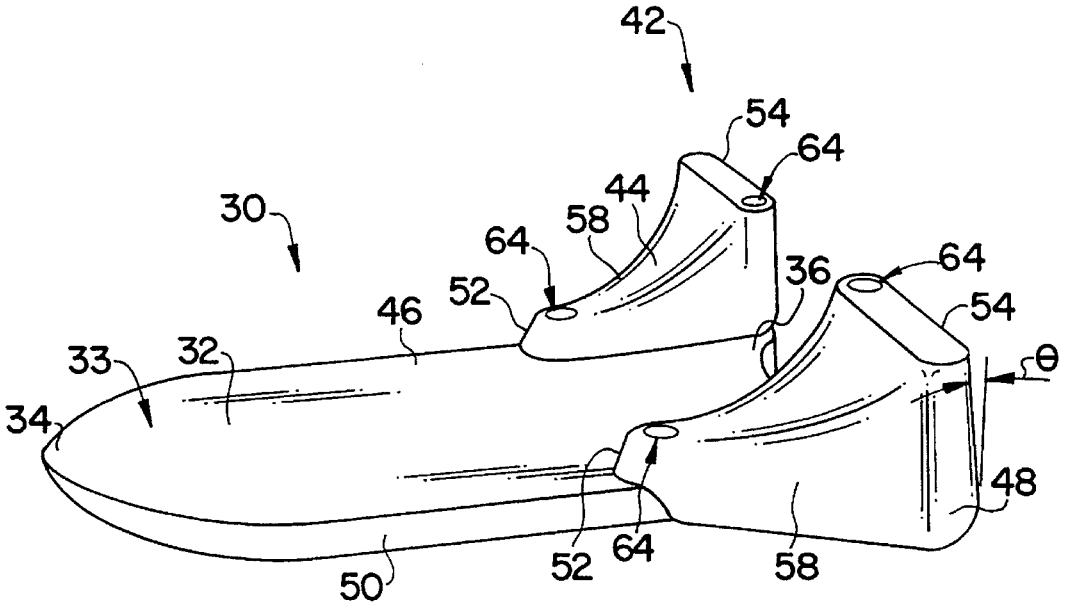
FIG. 1 is a front perspective view of a body board according to the principles of the present invention.
Figure 2:
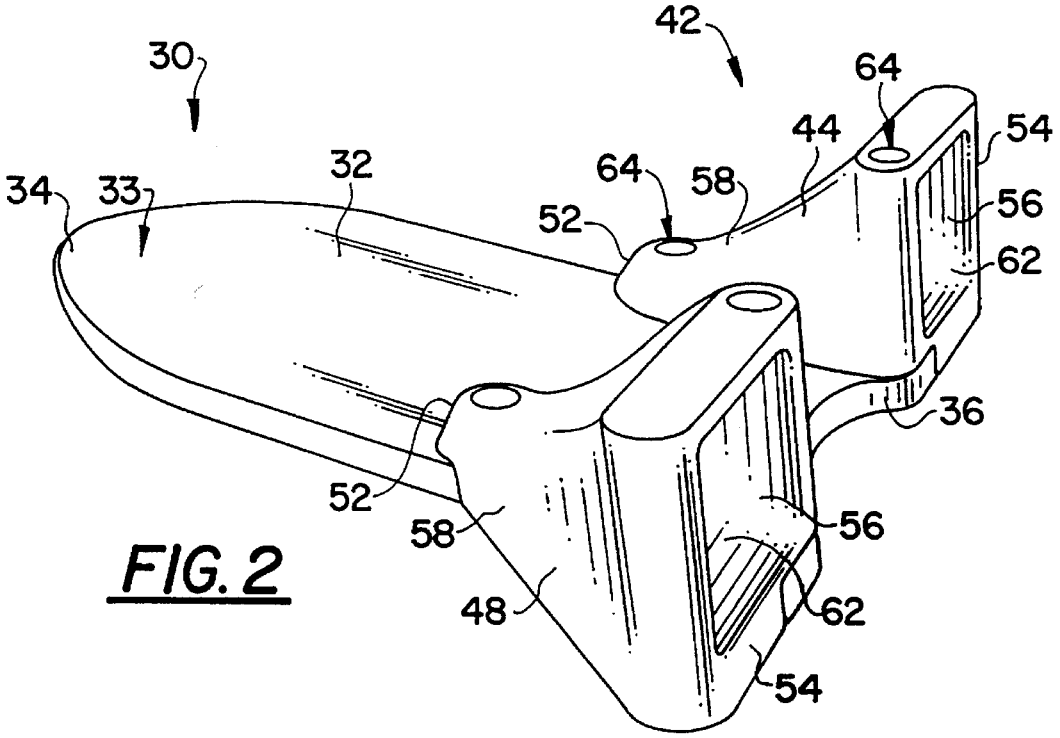
FIG. 2 is a rear perspective view of the body board illustrated in FIG. 1.
Figure 3:
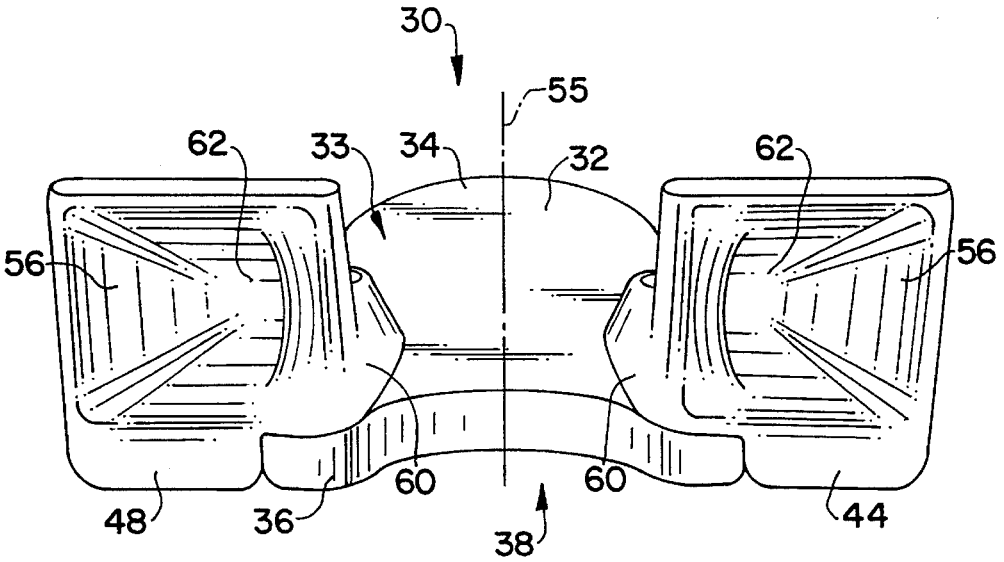
FIG. 3 is a perspective view of the body board illustrated in FIG. 1 when viewed directly from the rear of the body board.

FIG. 1 is a front perspective view of a body board which is generally indicated at 30. Body board 30 includes a body member 32 having a bow 34 and a stern 36. In the illustrated embodiment, body member 32 is substantially flat having an upper surface 33 that supports a person lying thereon. During normal use, the user lies on upper surface 33 of body member 32 so that user's upper torso is supported by upper surface 33 of body member 32 while the user's legs hang over stern 36. A cut-out portion 38 in body member 32 is provided at stern 36 so that the lower portion of the user's body can comfortably extend from stern 36. Bow 34 of body member 32 is rounded to allow body member 32 to move easily through a fluid such as water.

Figure 4:
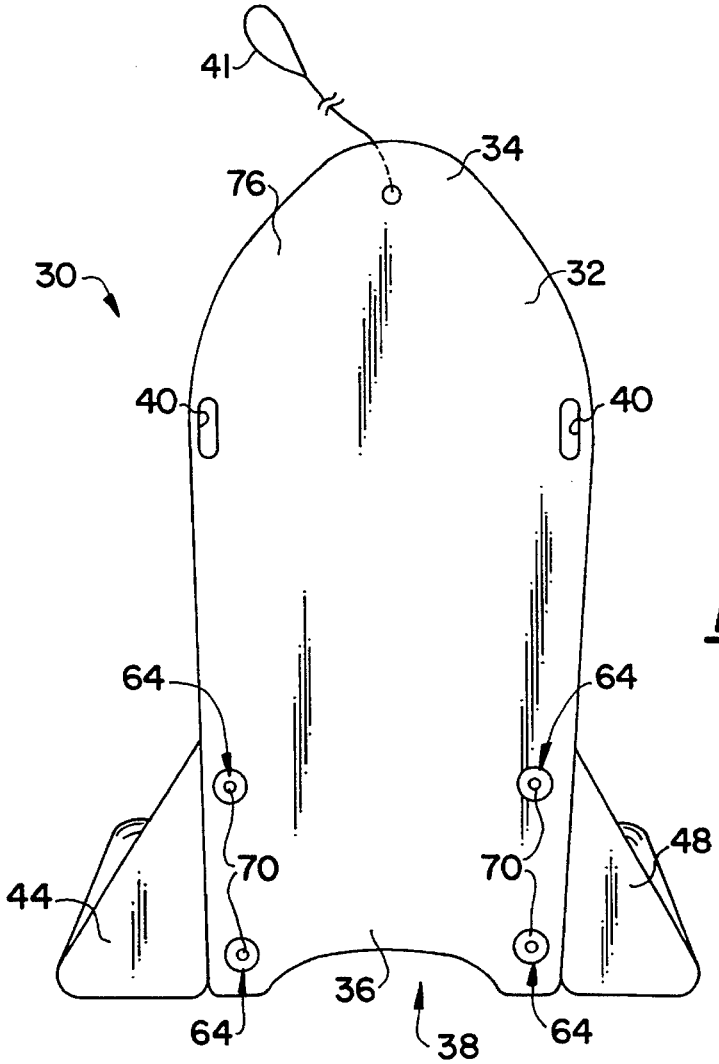
FIG. 4 is a bottom view of the body board illustrated in FIG. 1.
Figure 5:
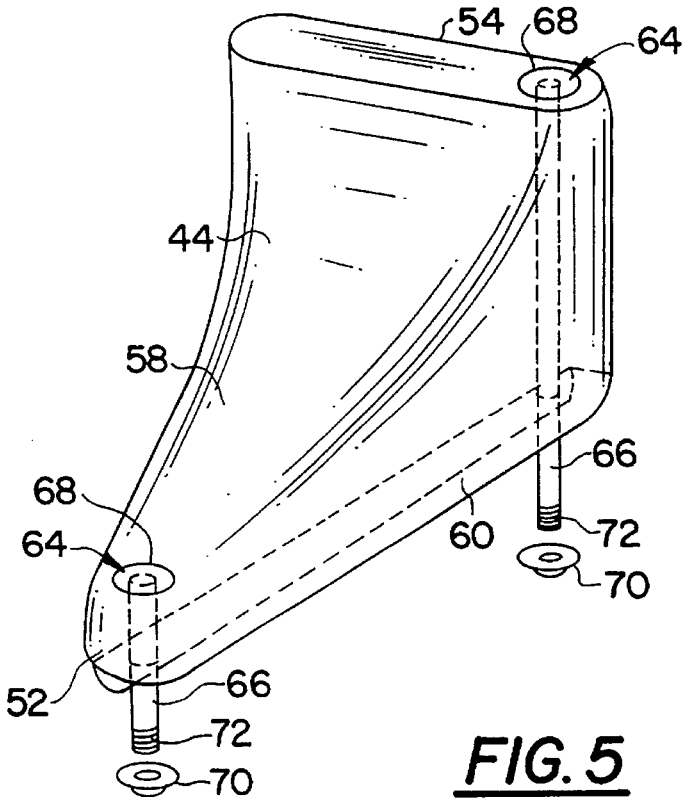
FIG. 5 is a perspective view of an extension used in the body board illustrated in FIG. 1.

While an exemplary embodiment of body member 32 is shown in FIGS. 1–4, it is possible for body member 32 to have other figurations and features. For example, body member 32 need not be entirely flat but, instead, may have raised portions that enhance the aesthetic appeal or aquadynamic profile thereof. Body member 32 may also have protrusions, such as fins or a keel, for stabilizing the body board. In addition, a rope or leash and/or handles can be provided at various locations on body member 32. FIG. 4 illustrates a body board having handles 40 and leash 41 so that the user can easily grip body member 32 and/or carry the body board. In the illustrated embodiment, the loop of leash 41 has an fastening device that allows the size of the loop to be adjusted. Leash 41 is attached to body member 32 in any conventional manner.

Body board 30 includes a propulsion system, generally indicated at 42. The propulsion system comprises a first extension 44 attached to a starboard side 46 of body member 32 and a second extension 48 attached to a port side 50 of body member 32. In the illustrated embodiment, first and second extensions 44 and 48 are selectively attached to body member 32 as discussed in greater detail below. However, it is to be understood that first and second extensions 44 and 48 can be formed integrally with body member 32. A detailed description of extensions 44 and 48 is provided below with reference to FIGS. 1–7.

Each extension 44 and 48 includes a first end 52 and a second end 54. When extensions 44 and 48 are coupled to body member 32, first end 52 is proximate to bow 34 and second end 54 is proximate to stern 36. Each extension 44 and 48 includes a rearward-facing surface 56 that generally faces away from stern 36 of body member 32 when extensions 44 and 48 are coupled thereto. Each extension 44 and 48 also includes a flared surface 58 that tapers outward in a direction from first end 52 toward second end 54. Flared surface 58 aquadynamically streamlines extensions 44 and 48 so that fluid can easily flow over each extension in a direction from first end 52 toward second end 54. Flared surface 58 also includes a rounded portion 60 on the interior side of extensions 44 and 48 facing one another so that the user lying on body member 32 is comfortably supported between extensions 44 and 48. Flared surface 58 is provided by shaping extension 44 and 48 such that a cross-sectional area of extension 44 and 48 increases in a direction from first end 52 toward second end 54, wherein the cross-sectional area of the extension is defined by a plane that is generally perpendicular to a longitudinal axis 55 of body member 32.

Each extension 44 and 48 is shaped so that the area defined by rearward-facing surface 56 corresponds to a maximum of the cross-sectional area of that extension and so that the maximum cross-sectional area is only located proximate to stern 36 of body member 32. Extension 44 and 48 are shaped in this manner so that a large surface area is provided at the rear of the body member. The greater the surface area at the rear of the body member, the greater the propulsive force generated by fluid striking rearward-facing surface 56.

Furthermore, because extensions 44 and 48 extend from the sides of body member 32, they act as outriggers further enhancing the stability of body board 30°. In addition, because extensions 44 and 48 are mounted at stern 36 of the body 32 and a made from a buoyant material, as discussed below, extensions 44 and 48 provide additional flotation at stern 36. This additional flotation reduces the amount by which 26 stern of body member 32 is deflected by the weight of the user, thereby further stabilizing the body board.

In the illustrated embodiment, each rearward-facing surface 56 of extensions 44 and 48 includes a recess 62 defined therein so that each rearward-facing surface 56 is bowl-shaped, when extensions 44 and 48 are viewed from the rear. Recess 62 allows the rear of the extension to act as a scoop, trapping fluid propelled against rearward-facing surface 56 within the bowl-like rearward-facing surface 56 thereby enhancing the ability of the fluid striking rearward-facing surface 56 to propel body board 30. That is, extensions 44 and 48 act as a pair of scoops against which fluid impacts so that body board 30 is propelled by the force of the fluid impacting rearward-facing surface 56. The depth of recess can vary depending on the amount of fluid to be trapped therein to maximize the propulsive ability of the extensions.

Extensions 44 and 48 are attached to or integral with body member 32 such that rearward-facing surface 56 extends above upper surface 33 of body member 32°. Providing extensions 44 and 48 relative to body member 32 in this manner ensures that a substantial portion of rearward-facing surfaces 56 is provided at water level, i.e., the surface of the water, even when the user is lying on body member 32, which tends to sink stern 36. Because the crashing of the waves occurs at the surface of the water, it is desirable to position rearward-facing surfaces 56 at the surface of the water so that the maximum force of the crashing waves impacts on rearward-facing surface 56.

In the illustrated embodiment, extensions 44 and 48 are symmetrically shaped and symmetrically disposed about longitudinal axis 55 of body member 32. In addition, rearward-facing surface 56 is angled slightly upward so that a plane defined by rearward-facing surface 56 is at an angle θ with respect to a plane that is perpendicular to the longitudinal axis of the body member. This upward angle θ of rearward-facing surface 56 enables body board 30 to present a relatively large rearward-facing surface at each extension to the incoming waves, even when the user is positioned on the body member. The weight of the rider will tend to sink the stern of the body member, thereby deflecting the stern downward. The upward angle of the rearward-facing surface in each extension ensures that rearward-facing surfaces 56 face the incoming waves rather then being deflected downward, even when the stern of the body member is deflected downward. A range of angles up to about 20° from vertical is sufficient to achieve this purpose.

In the illustrated embodiment, extensions 44 and 48 are removably attached to body member 32 via a fastening assembly, generally indicated at 64. However, as discussed above, extensions 44 and 48 can be made integral with body member 32. Extensions 44 and 48 are made from a rigid material and are attached to body member 32 so that an entirety of each extension is substantially maintained in a fixed position relative to body member 32. Making the entirety of each extension out of a substantially rigid material and fixing each extension to the body member so that there is substantially no movement of the extension relative to the body member minimizes the complexity of the propulsion system, thereby enhancing its reliability. Furthermore, it ensures that the greatest possible amount of force imparted on the rearward-facing surface of each extension by the crashing waves is transferred to the body member for propelling same.

Fastening assembly 64 includes a dowel member 66 that extends through each extension 44 and 48 and though body member 32. A first engaging member 68 is provided at a first portion of dowel member 66 proximate to an upper or flared surface of extensions 44 and 48 for engaging extensions 44 and 48. A second engaging member 70 is provided at a second portion of dowel member 66 proximate to a lower surface of body member 32 for engaging body member 32. In the illustrated embodiment, second engaging member 70 is removable from dowel member 66 by unthreading second engaging member 70 from threads 72 at the end of dowel member 66 so that dowel member 66 can be removed from body member 32 thereby detaching the associated extension. It is to be understood, however, that either engaging member 68 can also be removed and dowel member 66 removed from within the associated extension so that extensions 44 and 48 can be detached from body member 32. The above described fastening assembly enables extensions 44 and 48 to retrofitted onto existing body boards. In addition, extensions 44 and 48 can be easily detached from body member 32 so that body member 32 can be used alone, if desired, and so that the extensions and body member can be easily stored.

In the embodiment illustrated in FIGS. 1–5, extensions 44 and 48 include a substantially flat bottom surface 74 that is flush with a bottom surface 76 of body member 32 when extensions 44 and 48 are coupled thereto. This structure for extensions 44 and 48 minimizes the depth in which extension 44 and 48 protrude into the water, thereby reducing the drag on the body board. In addition, a substantially flat surface 78 abuts upper surface 33 of body member 32 when extensions 44 and 48 are coupled to body member 32 so that extension 44 and 48 securely engage body member 32.

Figure 6:
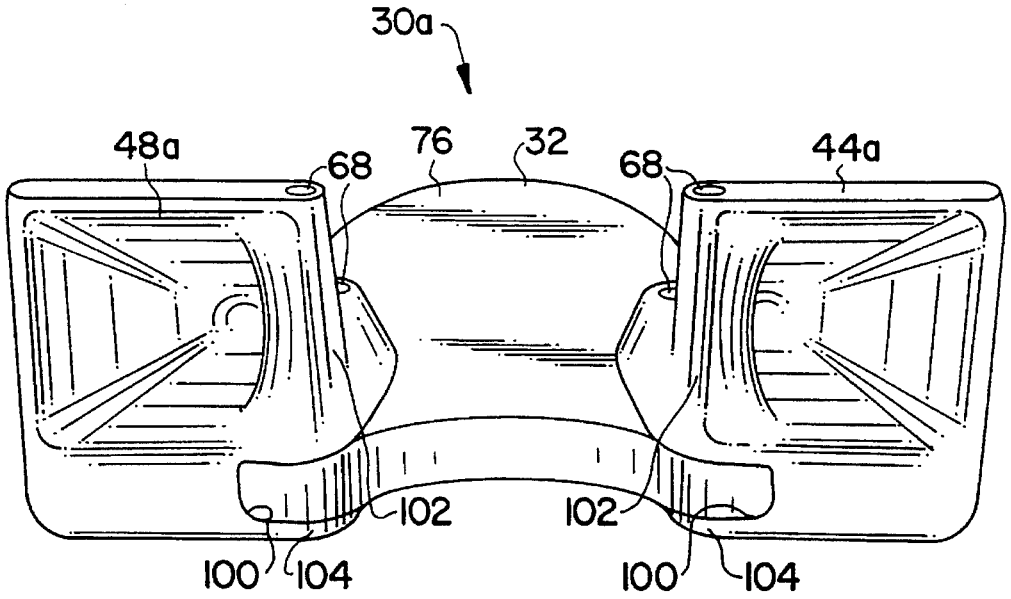
FIG. 6 is a perspective view of a body board according to a second embodiment of the present invention when viewed directly from the rear of the body board.
Figure 7:
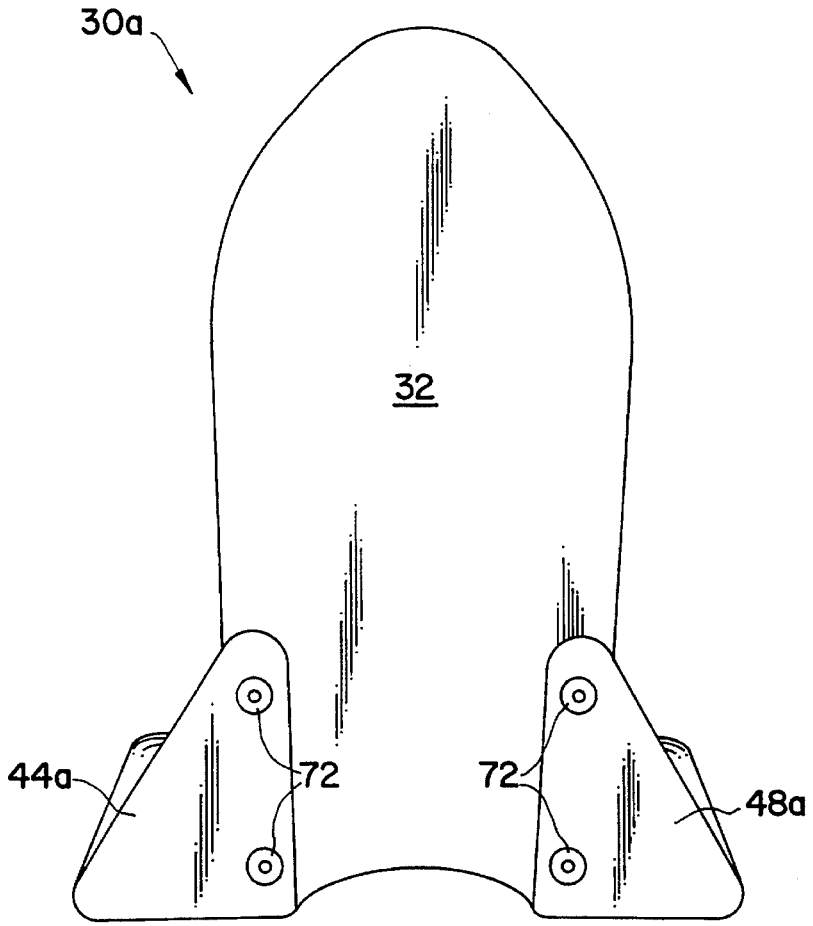
FIG. 7 is a bottom view of the body board illustrated in FIG. 6.

In a second embodiment of the present invention illustrated in FIGS. 6 and 7, extensions **44*a* and 44*a* each have a "U" shaped channel 100 that receives an edge portion of body member 32 therein. As in the previous embodiment, a fastening assembly including dowel members and engaging members selectively attach extensions 44*a* and 48*a* to body member 32. In this embodiment, however, the dowel members extend through an upper portion 102 of extensions 44*a* and 48*a*, through body member 32, and through a lower portion 104 of extensions 44*a* and 48*a*. This configuration for extension 44*a* and 48*a* provides a strong attachment of extensions 44*a* and 48*a* to body member 32 while still minimizing the depth in which the extensions protrude into the water. In addition, because lower portion 104 of extensions 44*a* and 48*a* is provided underneath body member 32, the buoyancy of body board 30*a*, especially at the stern, is enhanced. Because extensions 44*a* and 48*a* protrude under body member 32 by only a small amount, the drag caused by lower portion 104 of extensions 44*a* and 48*a* is minimized. In addition, the leading edge of lower portion 104** is shaped to reduce drag.

While two different configurations for attaching extension 44, 48 and **44*a*, 48*a* to the body member have been illustrated and discussed above, it is to be understood that other configurations for attaching the extensions to the body member are contemplated by the present invention. For example, the overlap of the extensions on the upper surface 76 of body member 32 in FIG. 6 can be eliminated so that extension 44*a* and 48*a* are attached to body member 32 by coupling only lower portion 104 to body member 32** via a fastening assembly.

Extensions 44, 48 and **44*a* and 48*a* and body member 32 can be made from a variety of materials, such as STYROFOAM or other substantially rigid foam-like material that is capable of withstanding a force applied thereto. Preferably, extensions 44, 48 and 44*a*, 48*a* and/or body member 32 are made from a material that is also buoyant and light weight. In addition, as will discussed below with respect to FIGS. 10–12**, the body member and/or extensions can also be made from an inflatable material.

Figure 8:
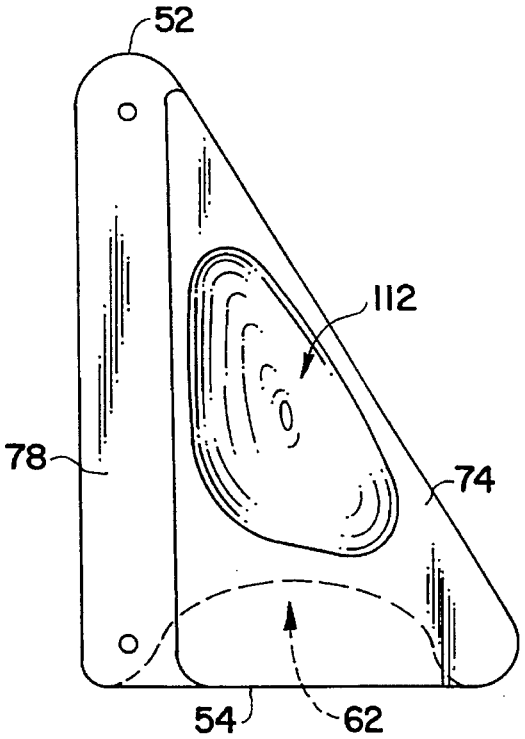
FIG. 8 is a bottom view of an alternative configuration for an extension according to the principles of the present invention.
Figure 13:
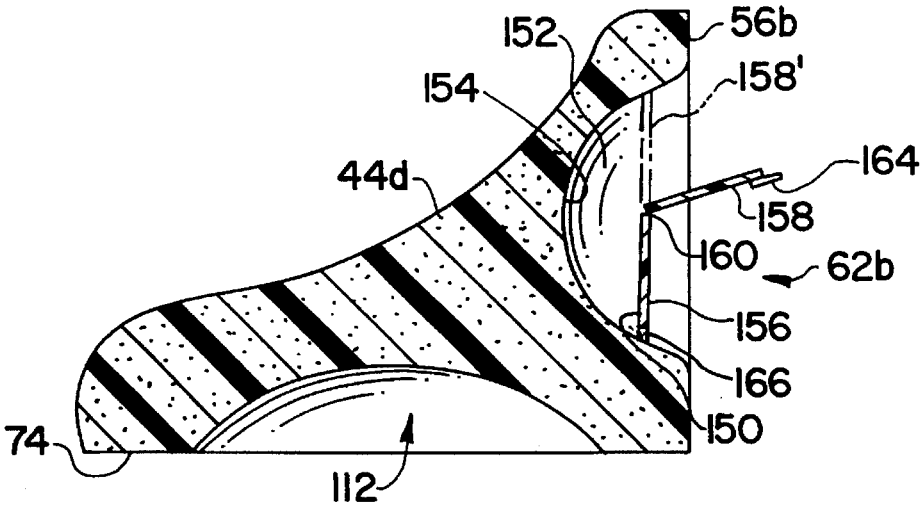
FIG. 13 is a side-sectional view the extension illustrated in FIG. 12.

Furthermore, it is to be understood that the extensions and recesses 62, can have a variety of shapes and sizes so long as these alternative configurations correspond to the principles of the present invention discussed above, An example of an alternative configuration for the extensions is illustrated in FIGS. 8 and 13. In the embodiment of the present invention illustrated in FIGS. 8 and 13, the extension includes a recess 112 defined in a bottom surface 74 thereof. Providing recess 112 at the bottom surface of each extension reduces the weight of each extension and decreases the amount of material required to fabricate each extension. In addition, recess 112 traps air underneath the extension when the body board is floating in an upright position, thereby enhancing the buoyancy of the body board.

Figure 9:
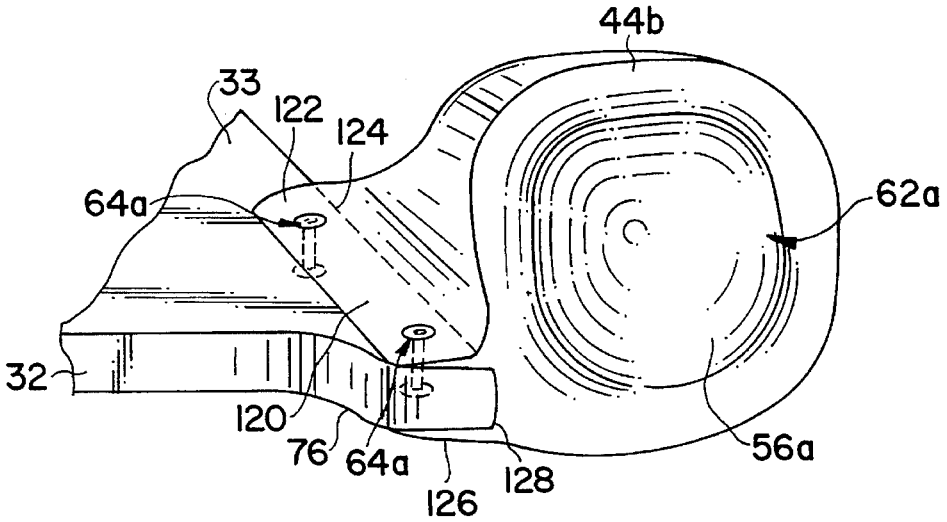
FIG. 9 is a partial rear perspective view of a body board according to a third embodiment of the present invention.

In a third embodiment of the present invention the extensions selectively attached to body member 32 are inflatable so that they can be conveniently stored when deflated. FIG. 9 is a partial perspective view showing the manner in which inflatable extension 44*b* is attached to body member 32. The attachment of inflatable extension 48*b* is not shown in FIG. 9 in order to simplify the illustration of the present invention. It is to be understood, however, that inflatable extension 48*b* is attached to body member 32 in the same manner as discussed below with reference to inflatable extension 44*b*. Furthermore, the description of inflatable extension 44*b* applies equally to inflatable extension 48*b*. The air pressure in inflatable extensions 44*b* and 48*b* ensure that they maintain their shape and remain in a fixed position relative to body member 32.

Inflatable extension 44*b* includes internal structures that enable the rearward-facing surface 56*a* thereof to have a recess 62*a* defined therein, as discussed above with respect to recess 62 in FIGS. 1–8. For example, inflatable extension 44*b* can include compartment walls that are attached to rearward-facing surface 56*a* and to another surface in inflatable extension 44*b*. Such interior compartment walls also maintain the shape of inflatable extension 44*b* so that rearward-facing surface 56*a* includes recess 62*a* defined therein when inflatable extension is inflated. Alternatively, recess 62*a* can be formed by providing a tensioning device, such as a string, attached to rearward facing surface 56*a* and to another portion of the inflatable extension, wherein the length of the string is such that the string pulls on rearward-facing surface 56*a* when the extension is inflated.

Inflatable extension 44*b* is attached to body member 32 by attaching an attachment portion 120 of inflatable extension 44*b* to body member 32. In the illustrated embodiment, attachment portion 120 of inflatable extension 44*b* includes a first attachment member 122 bonded to the material forming inflatable extension 44*b* along seam 124 and a second attachment member 126 bonded to the material forming inflatable extension 44*b* along seam 128. A fastening assembly 64*a*, which is similar to fastening assembly 64 discussed above, attaches first and second attachment members 122 and 126 on opposite sides of body member 32 through holes defined in the first and second attachment members such that first attachment member 122 is proximate to upper surface 33 and second attachment member 126 is proximate to bottom surface 76. In the illustrated embodiment, first and second attachment members 122 and 126 are made from plastic and are bonded to the material forming inflatable extension 44*b*. It is to be understood, however, that first and second attachment members 122 and 126 can be formed by folding the material forming inflatable extensions 44*b*.

Figure 10:
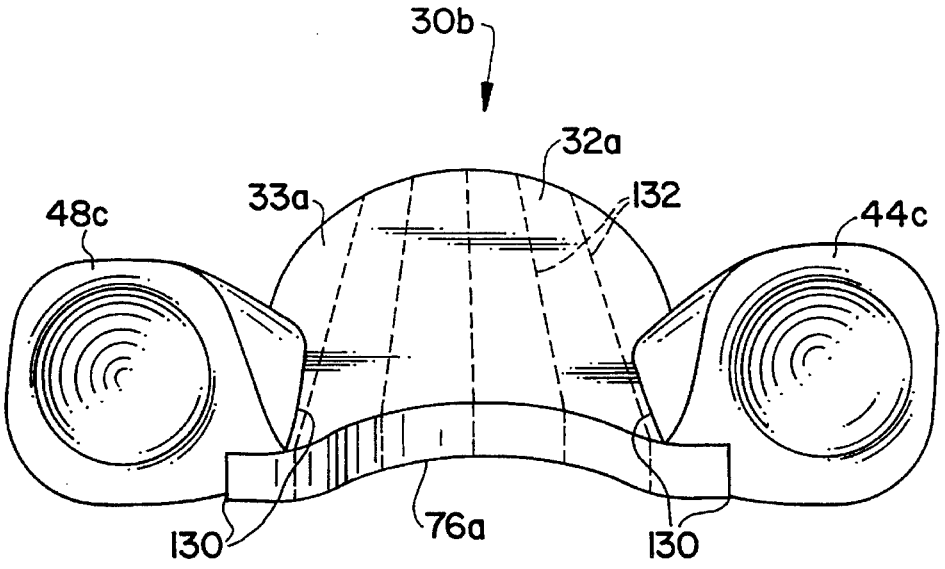
FIG. 10 is a perspective view of a fourth embodiment of the body board when viewed directly from the rear of the body board.
Figure 11:
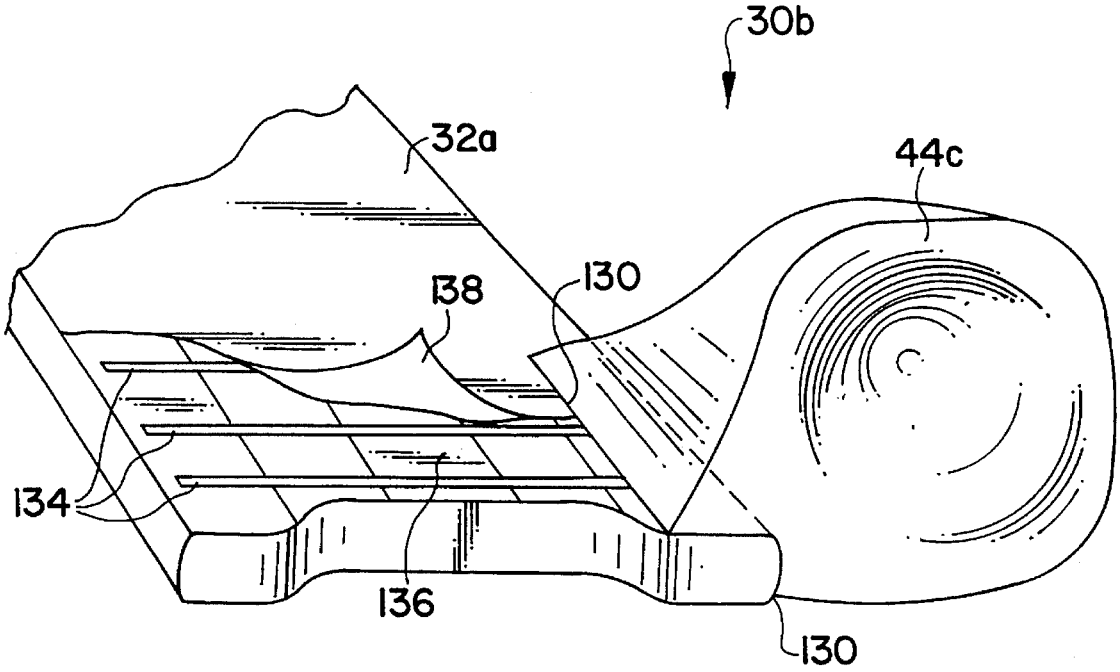
FIG. 11 is partial rear perspective view of the body board illustrated in FIG. 10.

In a fourth embodiment of the present invention, illustrated in FIGS. 10 and 11, both the body member 32*a* and the extensions 44*c* and 48*c* are inflatable. This configuration for the present invention enables the inflatable body board, generally indicated at 30*b*, to be collapsed into a size that is conveniently transported and/or stored.

In inflatable body board 30*a*, inflatable body member 32*a* and inflatable extensions 44*c* and 48*c* are integral with one another along seams 130. Inflatable body member 32*a* and inflatable extensions 44*c* and 48*c* can be formed such that all can be inflated at the same time through a common inflation valve. Alternatively, inflatable body member 32*a* and inflatable extensions 44*c* and 48*c* can be divided into separate sections so that each must be individually inflated through separate inflation valves. Inflatable body member 32*a* is maintained in a substantially flat shape by structures 132 within body member 32*a* that connect upper surface 33*a* to bottom surface 76*a*.

The stern of inflatable body member 32*a* is prevented from buckling under the weight of the user by the air pressure within inflatable body member 32*a*. In addition, rigid or semi-rigid support members 134 provided within inflatable body member 32*a* prevent bending of inflatable body member 32*a* about its longitudinal axis. In the illustrated embodiment, support members 134 are provided between a rubber material 136 and a fabric 138. Together, rubber material 136 and fabric 138 form the material used to form inflatable body member 32*a*, and inflatable extensions 44*b*, 48*b* and 44*c*, 48*c*.

It is to be understood that semi-rigid support members 134 can have a variety of configurations and can be attached to inflatable body member 32*a* in a variety of ways. For example, support members 134 can be removably inserted within sleeves (not shown) defined in an upper or bottom surface 33*a* or 76*a* of inflatable body member 32*a*. The number of support members 134, their size and thickness, as well as the material forming the support members are selected to achieve the desired amount of support at stern 36*a* of inflatable body member 32*a*. In an exemplary embodiment, support members 110 are made from wood, plastic or fiberglass.

Figure 12:
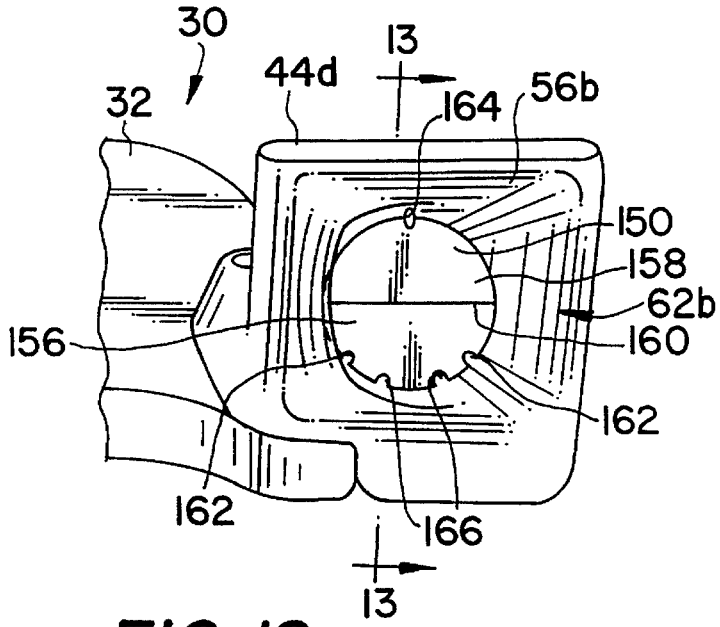
FIG. 12 is a rear perspective view of an extension used in a body board according to a fifth embodiment of the present invention.

In a fifth embodiment of the present invention, illustrated in FIGS. 12 and 13, the recess provided in the rearward-facing surface of at least one of the extension is utilized as a storage compartment. FIG. 12 illustrates an extension 44*d* that is similar to extension 44 illustrated in FIGS. 1–8. For example, a rearward-facing surface 56*b* of extension 44*d* includes a recess 62*b* defined therein. However, in this embodiment, a panel 150 is provided within recess 62*b* such that a storage compartment 152 is defined between an interior wall 154 or recess 62*b* and panel 150.

In the illustrated embodiment, panel 150 is separated into a first panel portion 156 and a second panel portion 158 by a hinge 160 so that second panel portion 158 can be opened and closed to provide access and deny access, respectively, to storage compartment 152. FIG. 13 illustrates the storage compartment in the open position. FIG. 12 and the dashed lines representing second panel portion 158' in FIG. 13 illustrate the storage compartment in the closed position. First panel portion 156 is secured within recess 62*b* by fastening members 162 that are secured to panel 150 and engage the wall of recess 62*b*. Fastening member 162 can be configured such that they permanently secure first panel portion 156 within recess 62*b*. Alternatively, fastening members 162 can be configured such that they selectively secure first panel portion 162 within recess 62*b* so panel 150 can be completely removed from within recess 62*b*. It is to be understood that, if desired, first panel portion 156 can be permanently secured within recess 62*b* in a variety of ways, such as by gluing or bonding first panel portion 156 to the wall of recess 62*b*. Second panel portion 158 is selectively secured within recess 62*b* by a manually operable latch 164 that also engages the wall of recess 62*b* so that compartment 152 can be opened or closed. Cutout portions 166 are provided in the lower portion of first panel portion 156 so that water or other fluids can drain from compartment 152.

In an exemplary embodiment of the present invention, panel 150 is made of plastic and a fold in the plastic provides hinge 160. In the embodiment described above, the second panel portion is moveable to provide access to compartment 152. It is to be understood, however, that the entirety of panel 150 can be removed from within recess **62*b* to provide access to compartment 152. In which case, panel 150 need not be separated into two panel portion and would not be permanently affixed within recess 62*b***.

While the present invention has been described in conjunction with what is presently considered to be the more practical preferred embodiment, it is to be understood that the invention is not be limited to the disclosed embodiments but, on the contrary, is intended to cover various modifications and equivalent arrangements included within the spirit and scope of the appended claims.

What is claimed is:

1. A body board comprising:

a body member having a bow and a stern providing a substantially flat surface capable of supporting a person lying thereon; and a pair of extensions coupled to said body member such that an entirety of each extension in said pair of extensions is maintained in a substantially fixed position relative to said body member, each extension in said pair of extensions providing a rearward-facing surface generally facing away from said stern of said body member so that fluid delivered in a direction generally from said stern toward said bow of said body member exerts a force against said rearward-facing surface to propel said body board, each extension being shaped so that an area defined by said rearward-facing surface is substantially equivalent to a maximum cross-sectional area of said extension, wherein a cross-sectional area of said extension is defined by a plane generally perpendicular to a longitudinal axis of said body member, and each extension being shaped so that said maximum cross-sectional area is only located proximate to said stern of said body member.

2. A body board according to claim 1, wherein said pair of extensions are symmetrically shaped and provided on each side of said body member proximate to said stern.

3. A body board according to claim 2, wherein each extension in said pair of extensions is removably attached to said body member via a fastening assembly.

4. A body board according to claim 3, wherein each extension in said pair of extensions includes a recess defined in said rearward-facing surface.

5. A body board according to claim 1, wherein each extension in said pair of extensions is removably attached to said body member via a fastening assembly.

6. A body board according to claim 5, wherein said fastening assembly comprises:

a dowel member inserted through an associated extension and said body member;

a first engaging member provided at a first portion of said dowel member for engaging said extension; and a second engaging member provided at a second portion of said dowel member for engaging said body member, wherein one of said first and said second engaging members is selectively removable from said dowel member.

7. A body board according to claim 1, wherein each extension in said pair of extensions is shaped such that said rearward-facing surfaces is disposed at an angle with respect to a plane perpendicular to said longitudinal axis of said body member.

8. A body board according to claim 1, wherein each extension in said pair of extensions includes a recess defined in said rearward-facing surface.

9. A body board according to claim 8, further comprising a panel provided within said recess such that a storage compartment is defined between a wall of said recess and said panel, and wherein at least a portion of said panel is movable to provide access to said storage compartment.

10. A body board according to claim 1, wherein each extension in said pair of extensions includes a recess defined in a bottom surface thereof, said bottom surface facing in a direction generally opposite said substantially flat surface of said body member.

11. A body board according to claim 1, wherein at least one of said body member and said pair of extensions are made from a buoyant material capable of maintaining its shape against a force applied thereto.

12. A body board according to claim 1, wherein at least one of said body member and said pair of extensions is made from an inflatable material which, when inflated, defines said at least one of said body member and said pair of extensions.

13. A body board according to claim 1, wherein said cross-sectional area of each extension generally increases over a length of each extension in a direction toward said stern of said body member so as to provide a aquadynamically streamlined surface generally facing said bow of said body member so that fluid flows easily over each extension in a direction from said bow to said stern.

14. A propulsion system that attaches to a body board including a body member that supports a user of said body board, said propulsion system comprising:

a first extension capable of being coupled to a starboard side of said body board such that an entirety of said first extension is maintained in a substantially fixed position relative to said body member;

a second extension capable of being coupled to a port side of said body board such that an entirety of said second extension is substantially maintained in a fixed position relative to said body member, said first extension and said second extension each having a first end and a second end, said first end facing a bow of said body board and a second end being proximate to a stern of said body board when said first extension and said second extension are coupled to said body board, said second end of said first and second extensions including a rearward-facing surface that generally faces away from said stern of said body board when said first and second extensions are coupled to said body board so that fluid delivered in a direction generally from said stern toward a bow of said body board exerts a force against said rearward-facing surface to propel said body board; and a fastening assembly for selectively securing said first and second extensions to said body board.

15. A propulsion system according to claim 14, wherein said first extension and said second extension are shaped so that an area defined by said rearward-facing surface of each extension is substantially equivalent to a maximum cross-sectional area of each extension, said cross-sectional area of each extension being defined by a plane generally perpendicular to a longitudinal axis of said body board.

16. A propulsion system according to claim 14, wherein said first and second extensions include a recess defined in said rearward-facing surface.

17. A body board according to claim 16, further comprising a panel provided within said recess such that a storage compartment is defined between a wall of said recess and said panel, and wherein at least a portion of said panel is movable to provide access to said storage compartment.

18. A body board according to claim 14, wherein said first extension and said second extension each have a cross-sectional area defined by a plane that is generally perpendicular to a longitudinal axis of said body member when said first extension and said second extension are coupled thereto; and wherein said cross-sectional area of each extension generally increases over a length of said extension in a direction from said first end toward said second end so as to provide a aquadynamically streamlined surface along a portion of a length of each extension so that fluid flows easily over each extension in a direction from said first end to said second end.

19. A propulsion system according to claim 14, wherein said fastening assembly comprises:

a dowel member inserted through an associated extension and said body member;

a first engaging member provided at a first portion of said dowel member for engaging said extension; and a second engaging member provided at a second portion of said dowel member for engaging said body member, wherein one of said first and said second engaging members is selectively removable from said dowel member.

20. A body board according to claim 14, wherein at least one of said body members said first extension and second extension is made from an inflatable material which, when inflated, defines at least one of said body member, said first extension and said second extension.

* * * * *